US006704525B2

(12) United States Patent
Oguma et al.

(10) Patent No.: US 6,704,525 B2
(45) Date of Patent: Mar. 9, 2004

(54) DEVELOPING DEVICE, PROCESS CARTRIDGE AND ELECTROPHOTOGRAPHIC IMAGE FORMING APPARATUS

(75) Inventors: Toru Oguma, Mishima (JP); Kazushi Watanabe, Mishima (JP); Toshiyuki Karakama, Sunto-gun (JP); Akiyoshi Yokoi, Sunto-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/822,276

(22) Filed: Apr. 2, 2001

(65) Prior Publication Data

US 2001/0038758 A1 Nov. 8, 2001

(30) Foreign Application Priority Data

Apr. 6, 2000 (JP) ..... 2000-105507

(51) Int. Cl.[7] ..... G03G 15/08
(52) U.S. Cl. ..... 399/27
(58) Field of Search ..... 399/27, 90, 107, 399/119

(56) References Cited

U.S. PATENT DOCUMENTS

| | | | | |
|---|---|---|---|---|
| 5,095,335 | A | 3/1992 | Watanabe et al. | 355/210 |
| 5,151,734 | A | 9/1992 | Tsuda et al. | 355/200 |
| 5,208,634 | A | 5/1993 | Ikemoto et al. | 355/215 |
| 5,223,893 | A | 6/1993 | Ikemoto et al. | 355/200 |
| 5,294,960 | A | 3/1994 | Nomura et al. | 355/210 |
| 5,331,372 | A | 7/1994 | Tsuda et al. | 355/200 |
| 5,345,294 | A | 9/1994 | Nomura et al. | 355/200 |
| 5,404,198 | A | 4/1995 | Noda et al. | 355/200 |
| 5,455,665 | A | 10/1995 | Baba et al. | 335/298 |
| 5,463,446 | A | 10/1995 | Watanabe et al. | 355/200 |
| 5,463,497 | A | 10/1995 | Muraki et al. | 359/618 |
| 5,465,136 | A | 11/1995 | Watanabe | 355/210 |
| 5,470,635 | A | 11/1995 | Shirai et al. | 438/131 |
| 5,475,470 | A | 12/1995 | Sasago et al. | 355/210 |
| 5,488,459 | A | 1/1996 | Tsuda et al. | 355/211 |
| 5,500,714 | A | 3/1996 | Yashiro et al. | 355/200 |
| 5,510,878 | A | 4/1996 | Noda et al. | 355/211 |
| 5,543,898 | A | 8/1996 | Shishido et al. | 355/210 |
| 5,561,504 | A | 10/1996 | Watanabe et al. | 355/215 |
| 5,583,613 | A | 12/1996 | Kobayashi et al. | 355/200 |
| 5,585,889 | A | 12/1996 | Shishido et al. | 355/200 |
| 5,585,895 | A | 12/1996 | Yashiro et al. | 355/215 |
| 5,602,623 | A | 2/1997 | Nishibata et al. | 399/111 |
| 5,608,509 | A | 3/1997 | Shirai et al. | 399/351 |
| 5,617,579 | A | 4/1997 | Yashiro et al. | 399/114 |
| 5,623,328 | A | 4/1997 | Tsuda et al. | 399/111 |
| 5,640,650 | A | 6/1997 | Watanabe et al. | 399/117 |
| 5,659,847 | A | 8/1997 | Tsuda et al. | 399/113 |

(List continued on next page.)

FOREIGN PATENT DOCUMENTS

| | | | |
|---|---|---|---|
| JP | 8-314359 | | 11/1996 |
| JP | 11-282310 | * | 10/1999 |
| JP | 11-316494 | * | 11/1999 |
| JP | 2000075639 | * | 3/2000 |
| JP | 2000219353 | * | 8/2000 |

*Primary Examiner*—Quana M. Grainger
(74) *Attorney, Agent, or Firm*—Fitzpatrick, Cella, Harper & Scinto

(57) ABSTRACT

A developing device to be mounted on an electrophotographic image forming apparatus main body and used for developing an electrostatic latent image formed on an electrophotographic photosensitive member, includes a developing container, an electrode attached to the inside of the developing container, a conductive member for securing electric conduction from the inside to the outside of the developing container, wherein the conductive member and the electrode are electrically connected by the conductive member being press-fit in a fitting portion provided in the electrode, and an elastic sealing member press-fit in a gap between the conductive member and the developing container.

20 Claims, 13 Drawing Sheets

U.S. PATENT DOCUMENTS

| | | | | |
|---|---|---|---|---|
| 5,669,042 | A | | 9/1997 | Kobayashi et al. ..... 399/111 |
| 5,689,774 | A | | 11/1997 | Shishido et al. ..... 399/111 |
| 5,749,027 | A | | 5/1998 | Ikemoto et al. ..... 399/113 |
| 5,768,658 | A | | 6/1998 | Watanabe et al. ..... 399/111 |
| 5,768,660 | A | | 6/1998 | Kurihara et al. ..... 399/111 |
| 5,774,766 | A | | 6/1998 | Karakama et al. ..... 399/111 |
| 5,790,923 | A | | 8/1998 | Oguma et al. ..... 399/106 |
| 5,794,101 | A | | 8/1998 | Watanabe et al. ..... 399/103 |
| 5,809,374 | A | | 9/1998 | Tsuda et al. ..... 399/111 |
| 5,812,909 | A | | 9/1998 | Oguma et al. ..... 399/103 |
| 5,828,928 | A | | 10/1998 | Sasago et al. ..... 399/111 |
| 5,878,304 | A | | 3/1999 | Watanabe et al. ..... 399/92 |
| 5,878,310 | A | | 3/1999 | Noda et al. ..... 399/117 |
| 5,884,124 | A | | 3/1999 | Karakama et al. ..... 399/123 |
| 5,890,036 | A | | 3/1999 | Karakama et al. ..... 399/119 |
| 5,899,602 | A | | 5/1999 | Noda et al. ..... 399/111 |
| 5,903,803 | A | | 5/1999 | Kawai et al. ..... 399/116 |
| 5,920,752 | A | | 7/1999 | Karakama et al. ..... 399/111 |
| 5,940,658 | A | | 8/1999 | Yokoi et al. ..... 399/119 |
| 5,943,528 | A | | 8/1999 | Akutsu et al. ..... 399/110 |
| 5,966,566 | A | | 10/1999 | Odagawa et al. ..... 399/109 |
| 5,966,568 | A | | 10/1999 | Numagami et al. ..... 399/111 |
| 5,987,269 | A | * | 11/1999 | Allen et al. ..... 399/27 |
| 6,006,058 | A | | 12/1999 | Watanabe et al. ..... 399/167 |
| 6,016,413 | A | | 1/2000 | Yokoyama et al. ..... 399/113 |
| 6,029,032 | A | | 2/2000 | Watanabe et al. ..... 399/111 |
| 6,032,007 | A | | 2/2000 | Yamaji et al. ..... 399/104 |
| 6,070,028 | A | | 5/2000 | Odagawa et al. ..... 399/104 |
| 6,075,956 | A | | 6/2000 | Watanabe et al. ..... 399/92 |
| 6,097,908 | A | | 8/2000 | Uchiyama et al. ..... 399/111 |
| 6,097,909 | A | | 8/2000 | Watanabe et al. ..... 399/111 |
| 6,101,354 | A | | 8/2000 | Nakagawa et al. ..... 399/225 |
| 6,118,960 | A | | 9/2000 | Nakagawa et al. ..... 399/111 |
| 6,128,454 | A | | 10/2000 | Kawai et al. ..... 399/116 |
| 6,144,398 | A | | 11/2000 | Yokoyama et al. ..... 347/263 |
| 6,144,821 | A | | 11/2000 | Oguma ..... 399/114 |
| 6,160,976 | A | | 12/2000 | Karakama et al. ..... 399/104 |
| 6,163,665 | A | | 12/2000 | Watanabe et al. ..... 399/111 |
| 6,169,866 | B1 | | 1/2001 | Watanabe et al. ..... 399/111 |
| 6,175,706 | B1 | | 1/2001 | Watanabe et al. ..... 399/167 |
| 6,226,478 | B1 | | 5/2001 | Watanabe et al. ..... 399/117 |

* cited by examiner

DEVELOPING DEVICE, PROCESS CARTRIDGE AND ELECTROPHOTOGRAPHIC IMAGE FORMING APPARATUS

BACKGROUND OF THE INVENTION

1. Field of the Invention

The present invention relates to an electrophotographic image forming apparatus which forms an electrostatic latent image on an electrophotographic photosensitive member by an electrophotographic method and visualize the electrostatic latent image by developer contained in a developing device, a developing device and a process cartridge.

Here, the electrophotographic image forming apparatus includes, for example, an electrophotographic copying machine, an electrophotographic printer (e.g., an LED printer, a laser beam printer), an electrophotographic facsimile machine and an electrophotographic word processor.

In addition, the process cartridge is a cartridge in which at least one of charging means, developing means and cleaning means and an electrophotographic photosensitive member are integrally incorporated and which is detachably mountable on an electrophotographic image forming apparatus main body, or a cartridge in which at least developing means and an electrophotographic photosensitive member are integrally incorporated and which is detachably mountable on an electrophotographic image forming apparatus main body.

2. Related Background Art

Conventionally, in an electrophotographic image forming apparatus using an electrophotographic image forming process, a process-cartridge method is widely employed with which an electrophotographic photosensitive member and processing means acting on the electrophotographic photosensitive member are integrally incorporated in a cartridge, which is made detachably mountable on an electrophotographic image forming apparatus main body.

In such a process cartridge method, operability can be remarkably improved because an apparatus can be maintained by a user in person rather than by a repairer.

In addition, in an electrophotographic image forming apparatus of such a process cartridge method, a user replaces the cartridge in person. Thus, some apparatuses are provided with toner amount detecting means in order to let a user notice that only a little developer (toner) remains. As the toner amount detecting means, there is a method of detecting a toner amount by detecting a change of capacitance between two electrodes disposed in a process cartridge.

As a configuration of such electrodes, a conductive member is disposed a predetermined distance apart from a developer bearing member (for detecting capacitance between the conductive member and a developing roller).

The present invention has been devised by further developing the above-mentioned conventional art.

SUMMARY OF THE INVENTION

It is an object of the present invention to provide a developing device and a process cartridge which prevent developer from leaking outside, an electrophotographic image forming apparatus using the developing device, and an electrophotographic image forming apparatus on which the process cartridge is detachably mountable.

It is another object of the present invention to provide a developing device and a process cartridge which can be easily assembled, an electrophotographic image forming apparatus using the developing device, and an electrophotographic image forming apparatus on which the process cartridge is detachably mountable.

It is yet another object of the present invention to provide a developing device and a process cartridge which is capable of securely making electrical connection with an apparatus main body, an electrophotographic image forming apparatus using the developing device, and an electrophotographic image forming apparatus on which the process cartridge is detachably mountable.

It is yet another object of the present invention to provide a developing device, a process cartridge and an electrophotographic image forming apparatus which can be easily assembled and are capable of certainly preventing the occurrence of developer leakage and securely making electrical connection with the inside and the outside of a developing container.

It is yet another object of the present invention to provide a developing device that comprises a developing container; an electrode to be mounted inside the developing container; a conductive member for securing electric conduction from the inside to the outside of the developing container, wherein the conductive member and the electrode are electrically connected by the conductive member being pressed into a fitting portion provided in the electrode; and an elastic seal member pressed into an interval between the conductive member and the developing container, a process cartridge having the developing device, an electrophotographic image forming apparatus using the developing device and an electrophotographic image forming apparatus on which the process cartridge is detachably mountable.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

A developing device, a process cartridge and an electrophotographic image forming apparatus in accordance with the present invention will be hereinafter described in detail with reference to the accompanying drawings.

Embodiment 1

Figure 1:
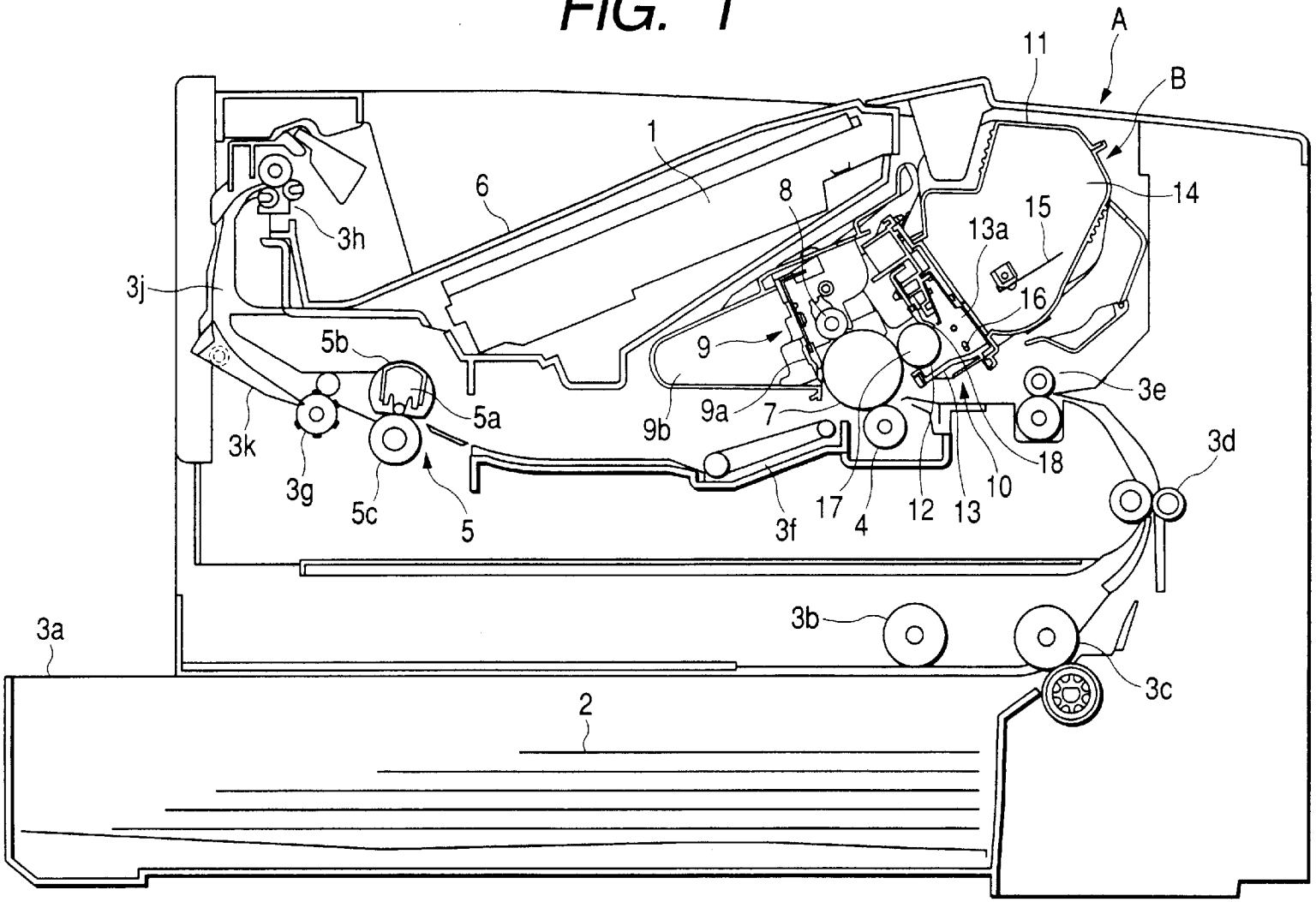
FIG. 1 is a schematic view showing a configuration of an embodiment of an electrophotographic image forming apparatus in accordance with the present invention.

An embodiment of an electrophotographic image forming apparatus on which a process cartridge is detachably mountable, which is configured in accordance with the present invention, will be described first with reference to FIGS. 1 and 2.

An electrophotographic image forming apparatus A has a drum-shaped electrophotographic photosensitive member, that is, a photosensitive drum 7. The photosensitive drum 7 is charged by a charging roller 8 being charging means and, then, an electrostatic latent image corresponding to image information is formed on the photosensitive drum 7 by irradiation with laser beams corresponding to the image information from optical means 1 as electrostatic latent image forming means having a laser diode, a polygon mirror, a lens and a reflecting mirror. This electrostatic latent image is developed by developing means 10 to be a visible image, that is, a toner image.

The developing means 10 forms a developer container 11 in which a developing frame 13 holding a developing roller 12 being a developer bearing member and a toner containing portion 14 containing toner being developer are connected. Further, the developer used in this embodiment is magnetic developer.

The developing frame 13 has a developing chamber 13*a*, and toner in the toner containing portion 14 adjacent to the developing chamber 13*a* is fed to the developing roller 12 of the developing chamber 13*a* by the rotation of a toner feeding member 15. The developing frame 13 is provided with a toner agitating member 16 in the vicinity of the developing roller 12, which circulates the toner in the developing chamber 13*a*. In addition, the developing roller 12 incorporates a stationary magnet 17 being magnetic field generating means, and the toner is conveyed by rotating the developing roller 12. Then, triboelectrification charge is induced by a developing blade 18 to layer the toner in a predetermined thickness and the toner layer is conveyed to a developing region of the photosensitive drum 7. The toner fed to this developing region is transferred to an electrostatic latent image on the photosensitive drum 7 to form a toner image. The developing roller 12 is connected to a developing bias circuit (not shown), and, developing bias voltage, which is alternating voltage with direct voltage superimposed, is usually impressed on the developing roller 12.

On the other hand, a recording medium 2 set in a feed cassette 3*a* is conveyed to a transferring position by a pickup roller 3*b*, a conveying roller pairs 3*c* and 3*d*, and a registration roller pair 3*e* in synchronism with forming the toner image. A transferring roller 4 as transferring means is disposed in the transferring position, which transfers the toner image on the photosensitive drum 7 to the recording medium 2 by impressing voltage.

The recording medium 2 having received the transfer of the toner image is conveyed to fixing means 5 by a conveying guide 3*f*. The fixing means 5 is provided with a driving roller 5*c* and a fixing roller 5*b* incorporating a heater 5*a*, and fixes the transferred toner image on the recording medium 2 by impressing heat and pressure on the passing recording medium 2.

The recording medium 2 is conveyed by a discharge roller pairs 3*g* and 3*h*, and is discharged to a discharge tray 6 through a surface reverse path 3*j*. The discharge tray 6 is provided on an upper surface of the electrophotographic image forming apparatus A. Further, the recording medium 2 can also be discharged without passing through the surface reverse path 3*j* by activating a swingable flapper 3*k*. In this embodiment, conveying means is composed of the pickup roller 3*b*, the conveying roller pairs 3*c* and 3*d*, the registration roller pair 3*e*, the conveying guide 3*f*, and the discharging roller pairs 3*g* and 3*h*.

The photosensitive drum 7 after the toner image is transferred to the recording medium 2 by the transferring roller 4 is supplied to the next image forming process after removing residual toner on the photosensitive drum 7 by cleaning means 9. The cleaning means 9 scrapes off and collects the residual toner on the photosensitive drum 7 to a waste toner reservoir 9*b* by an elastic cleaning blade 9*a* that is in contact with the photosensitive drum 7.

Figure 2:
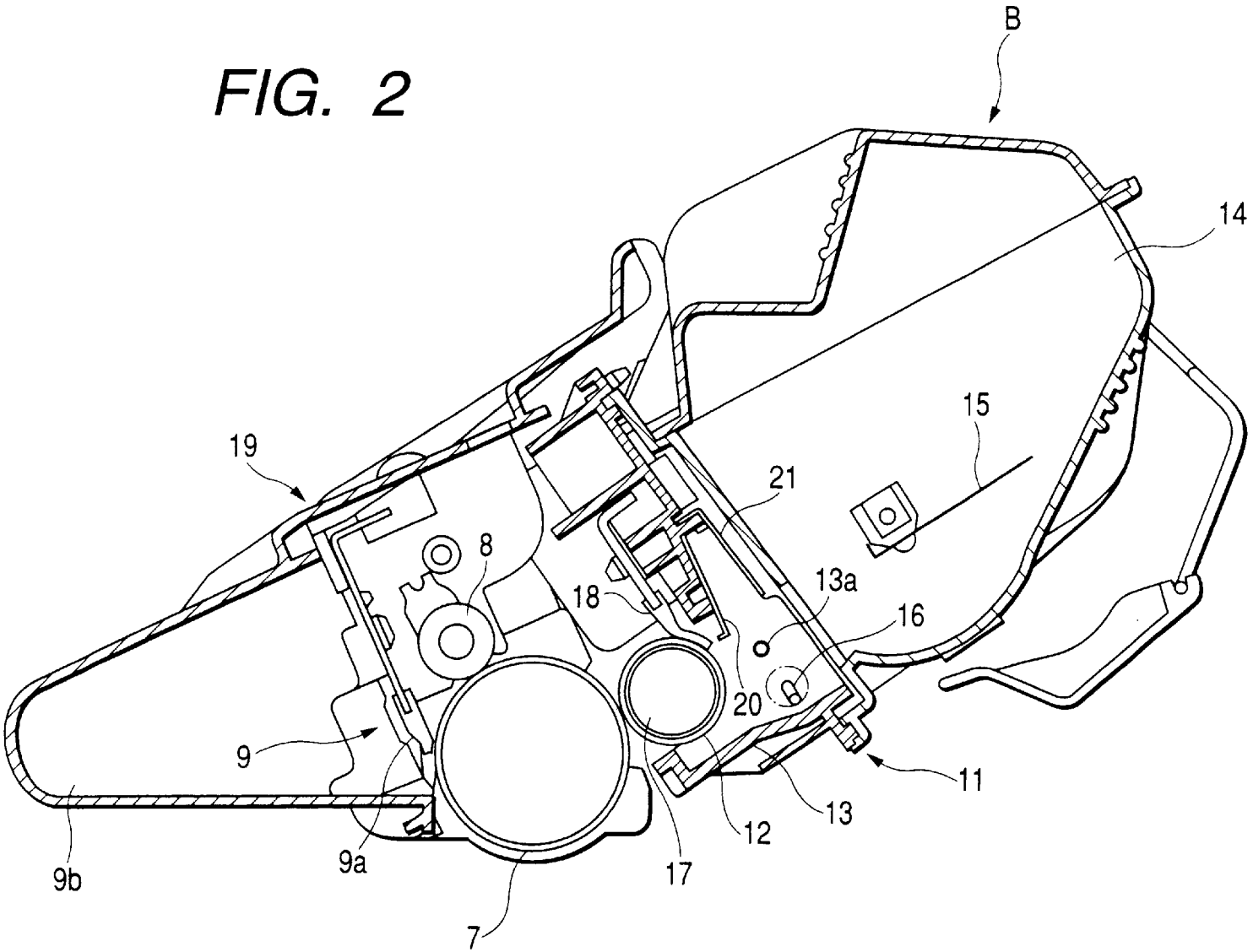
FIG. 2 is a vertical sectional view of an embodiment of a process cartridge in accordance with the present invention.

On the other hand, in this embodiment, the developing container 11 is formed by integrally welding the developing frame 13 holding developing means, such as the developing roller 12, and the developing blade 18 to the toner containing portion 14, which contains toner and has the toner feeding member 15, and a cleaning unit 19 to which the photosensitive drum 7, the cleaning means 9, such as the cleaning blade 9*a*, and the charging roller 8 are attached is integrally connected to the developing container 11, thereby forming a process cartridge B as a cartridge as shown in FIG. 2.

Figure 3:
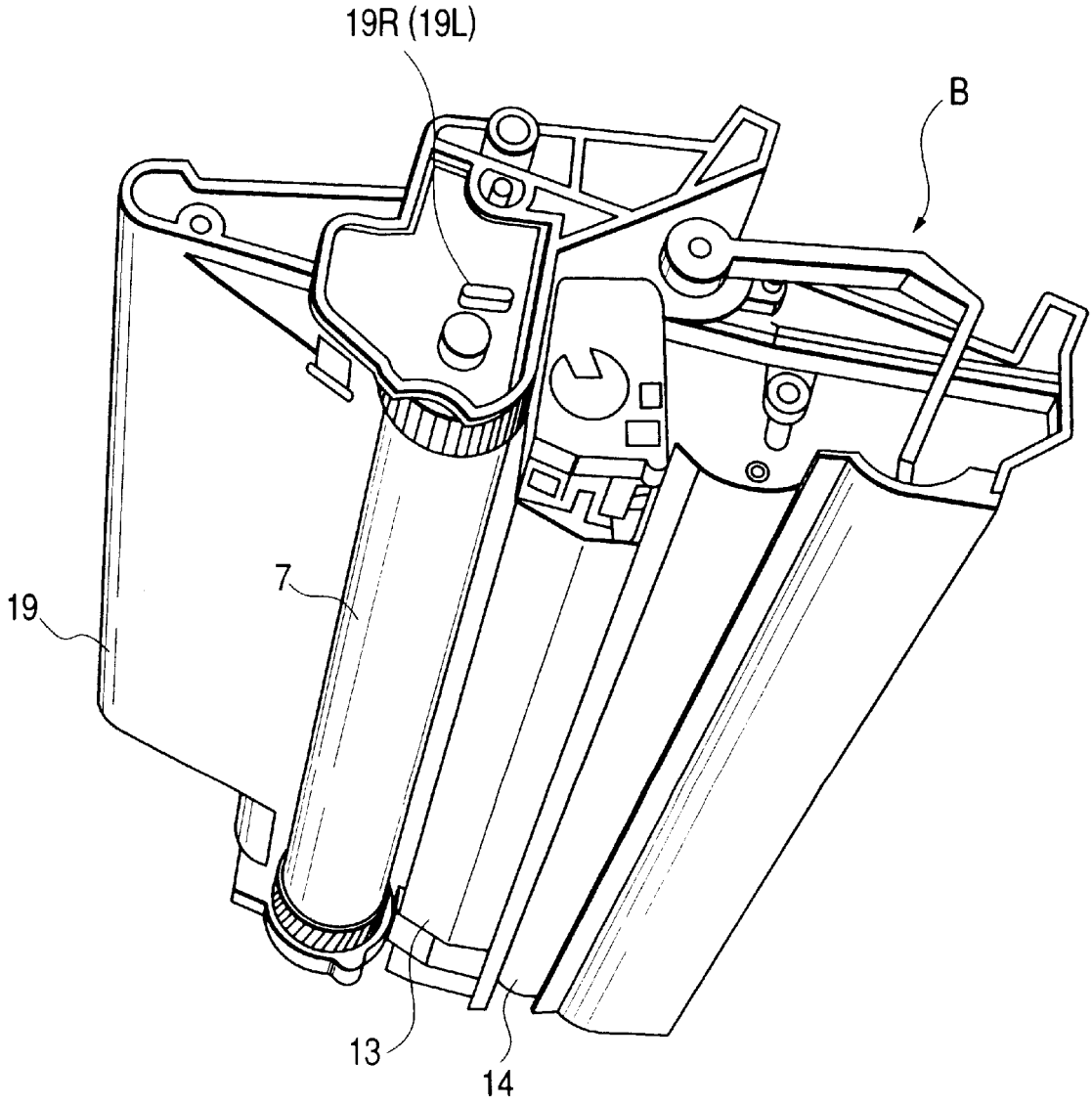
FIG. 3 is a pictorial perspective view of the process cartridge in accordance with the present invention which is viewed upward from the bottom.
Figure 4:
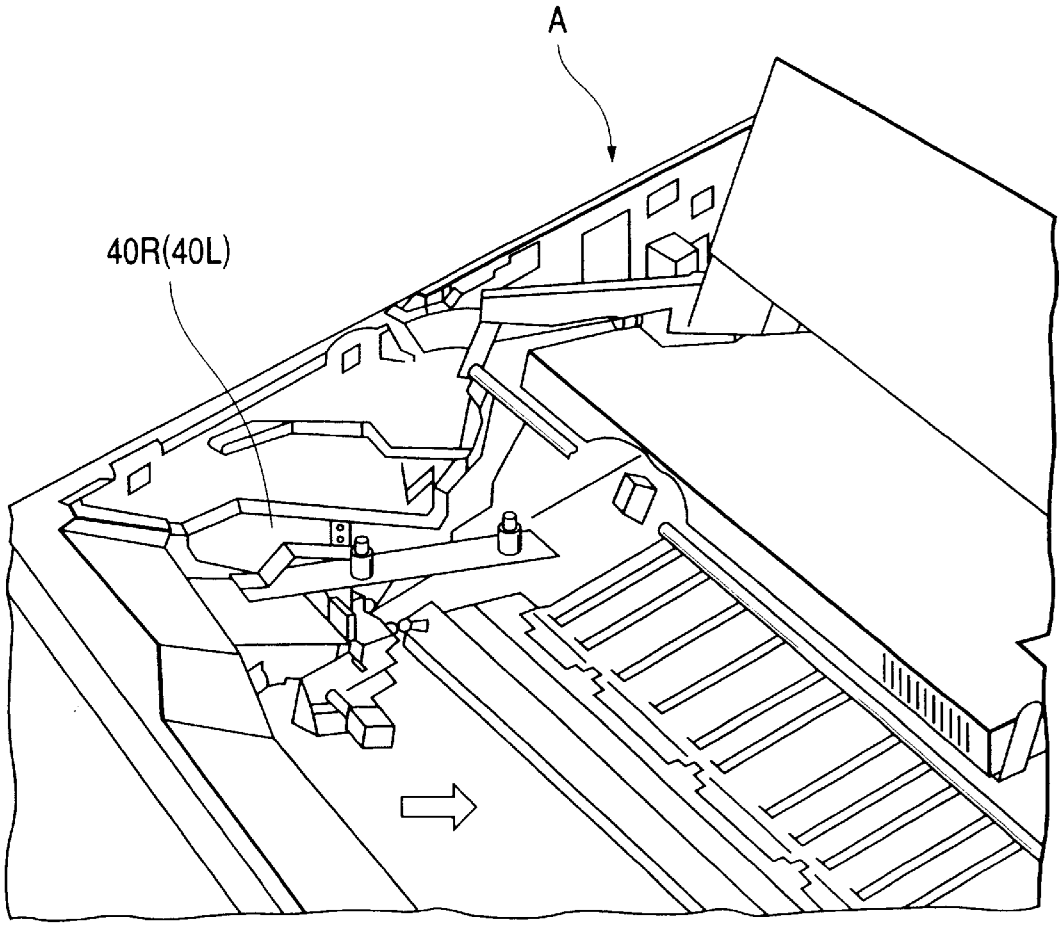
FIG. 4 is a pictorial perspective view showing an inserting portion of an apparatus main body in which a process cartridge is inserted.

This process cartridge B is detachably mounted on cartridge inserting means provided in the image forming apparatus main body by a user. According to this embodiment, the cartridge mounting means is composed of guiding means 19R (19L), shown in FIG. 3, formed on both sides of the process cartridge B and a guide portion 40R (40L) (see FIG. 4) formed in the image forming apparatus main body A to which this guiding means 19R (19L) can be mounted.

Referring to FIG. 2 again, the process cartridge B of this embodiment is provided with a first and a second detection electrodes 20 and 21 as the toner amount detecting means that is capable of detecting a residual amount of toner according to the consumption of the toner in the developing container 11. The first and the second detection electrodes 20 and 21 are arranged in a position where they contact the toner in the developing container 11 and where a contacting area with the toner fluctuates as the toner decreases. According to this embodiment, the first and the second detection electrodes 20 and 21 are arranged opposing the developing roller 12 along its longitudinal direction, and are configured to induce a capacitance between both the electrodes 20 and 21 by impressing voltage on either the first detection electrode 20 or the second detection electrode 21 and detect a toner amount by measuring the output voltage at this point in the electrophotographic image forming apparatus main body A.

Figure 5:
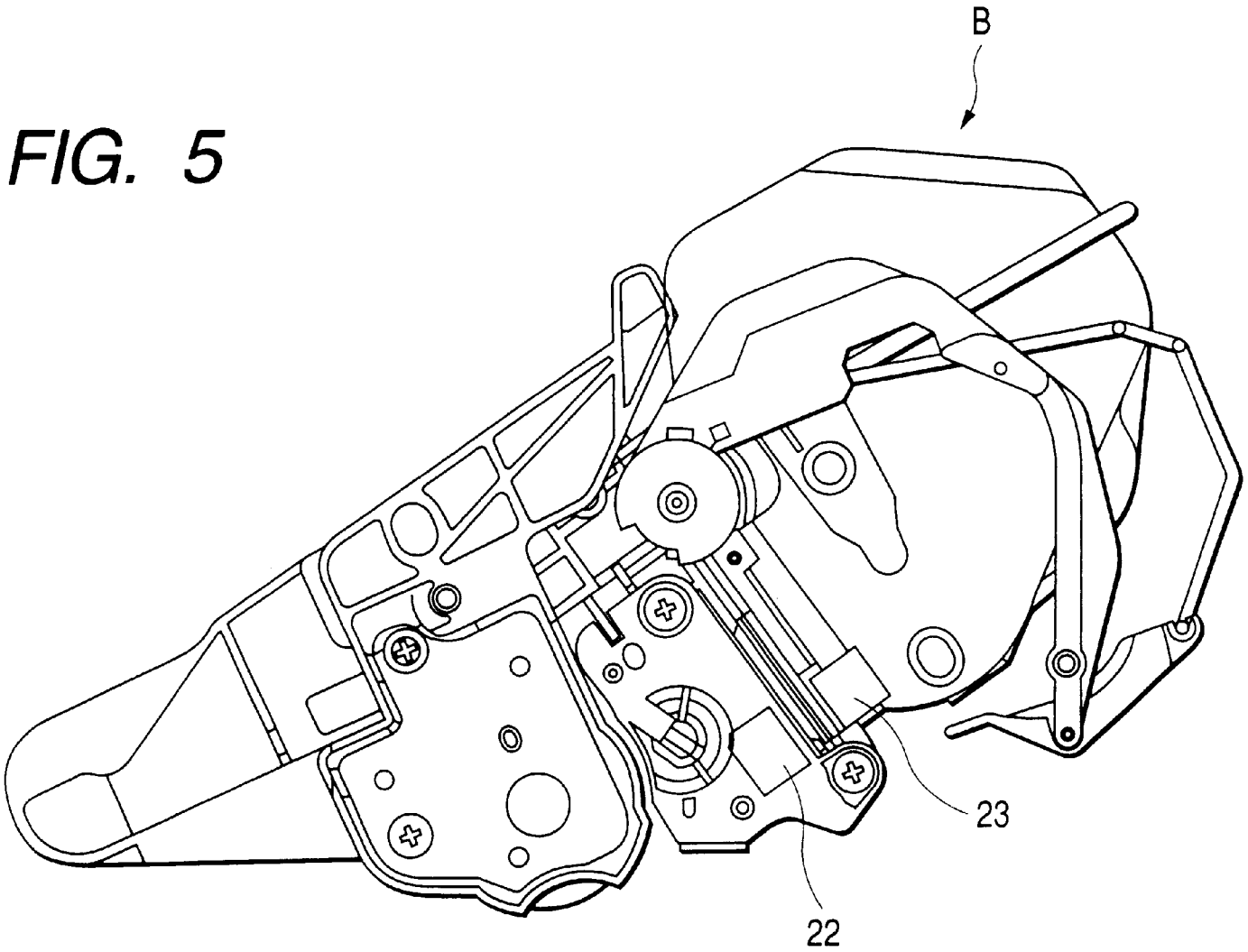
FIG. 5 is a side view of the process cartridge of FIG. 2.

When the process cartridge B is mounted in the image forming apparatus main body, the first and the second detection electrodes 20 and 21 are required to be electrically connected to the electrophotographic image forming apparatus main body A. Therefore, a first and a second electric contacts 22 and 23 for securing electric conduction with the image forming apparatus main body A are exposed on the side of the process cartridge B as shown in FIG. 5.

A method for connecting from the first detection electrode 20 to the first electric contact 22 will now be described with reference to FIGS. 6 to 8.

The detection electrode 20 is positioned by a positioning pin 13*c* provided on an attaching surface 13*b* of the developing frame 13, and is stuck to the attaching surface 13*b* by, for example, a pressure sensitive adhesive double coated tape. An arm portion 20*a* extends from one end of the detection electrode 20 in its longitudinal direction, and an incised clinch 20*b* is formed as a fitting portion at the end of the arm portion 20*a*. When the detection electrode 20 is attached to the developing frame 13, the incised clinch 20*b* is inserted in a groove 13*d* formed in the developing frame 13.

On the other hand, a hole 13*e* that penetrates from the inside to the outside of the frame is drilled beside the groove 13*d* of the developing frame 13, which matches a hole 20*c* of the incised clinch 20*b*. In addition, the hole 13*e* of the developing frame 13 is shaped such that an elastic sealing member 24 of the type described in Japanese Patent Application Laid-Open No. 8-314359 is fit, in which the elastic sealing member 24 is press-fit from the outside of the developing frame 13. Thereafter, an electrode 25 penetrates the elastic sealing member 24 to be inserted in the developing frame 13, and is press-fit in the incised clinch 20*b* of the detection electrode 20 attached inside the developing frame 13 to be electrically connected.

Figure 8:
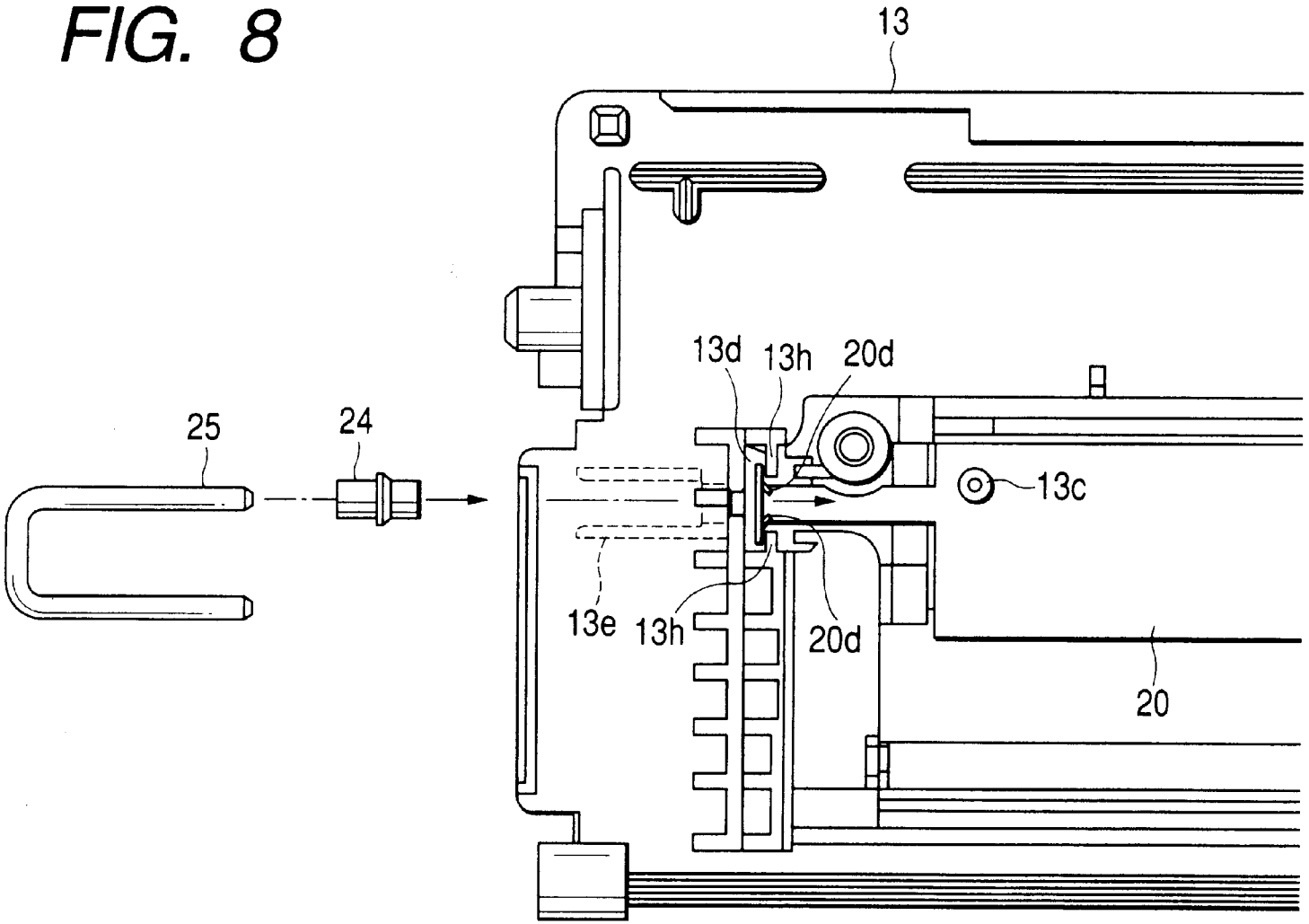
FIG. 8 is a partially enlarged view of a detection electrode in accordance with the present invention.

As shown in FIG. 8, the incised clinch 20*b* is provided with a pair of pawls 20*d* opposing in the vertical direction in FIG. 8. Since the interval between the points of the pawls 20*d* is made smaller than the external diameter of the electrode before the electrode 25 is combined with the detection electrode 20, when the electrode 25 is press-fit, the points of the pawls 20*d* are embedded in the electrode 25, and thus electric conduction can be secured. In addition, since a rib 13*h* is provided in the developing frame 13 in order to support the incised clinch 20*b* when the electrode 25 is combined with the detection electrode 20, the electrode 25 can be easily combined with the detection electrode 20 simply by forcing it in.

The interval between the points of the pawls 20*d* may be appropriately determined according to a material or a thickness of an electrode to be used, a diameter of an electrode, or the like. In this embodiment, an SUS material with a thickness of 0.3 mm is used as the detection electrode 20, and an SUS rod with an external diameter of 2 mm is used as the electrode 25. In addition, the interval between the points of the pawls 20*d* is set at 1.6 to 1.8 mm.

Figure 6:
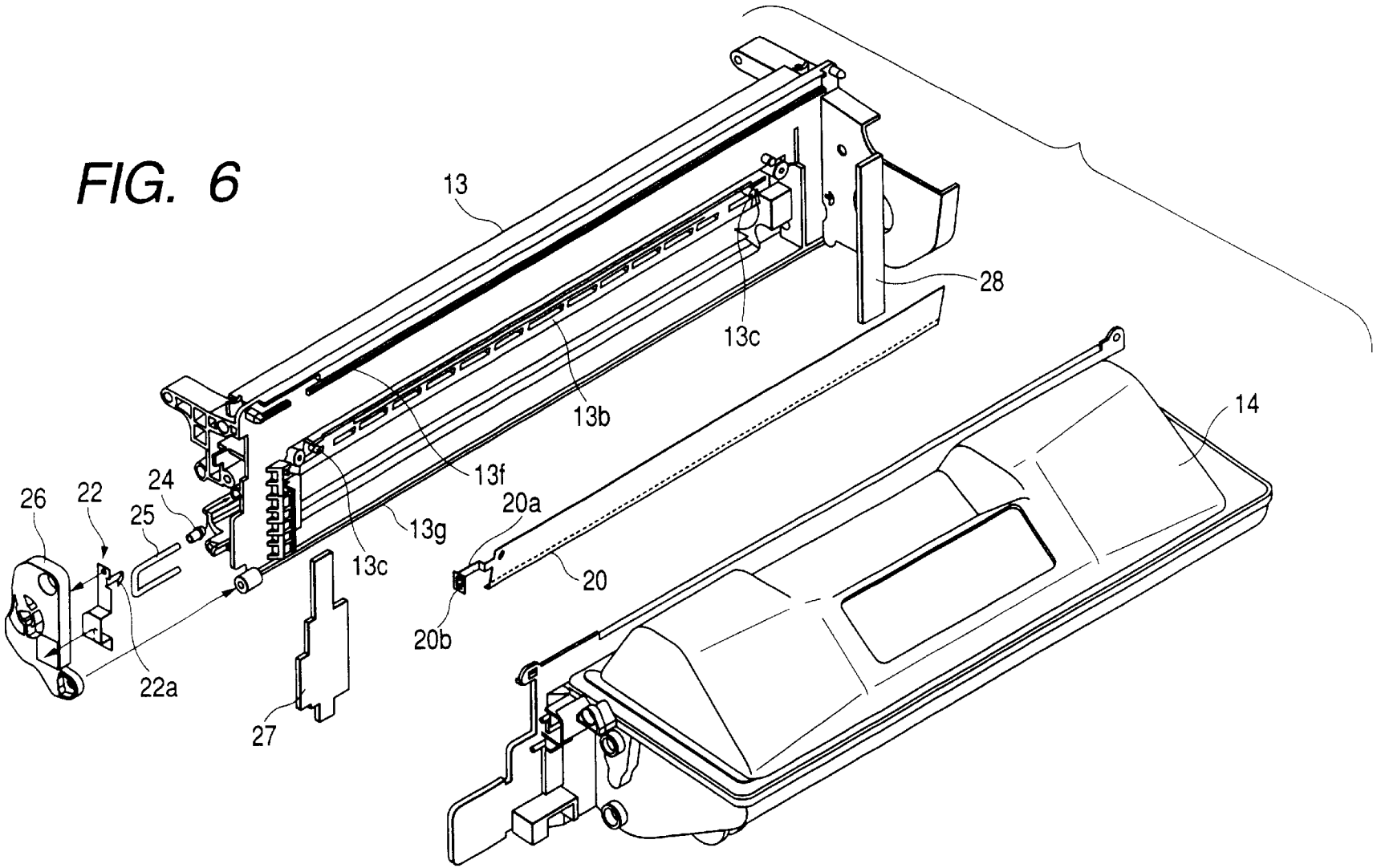
FIG. 6 is an exploded perspective view of an embodiment of a developing frame in accordance with the present invention.
Figure 7:
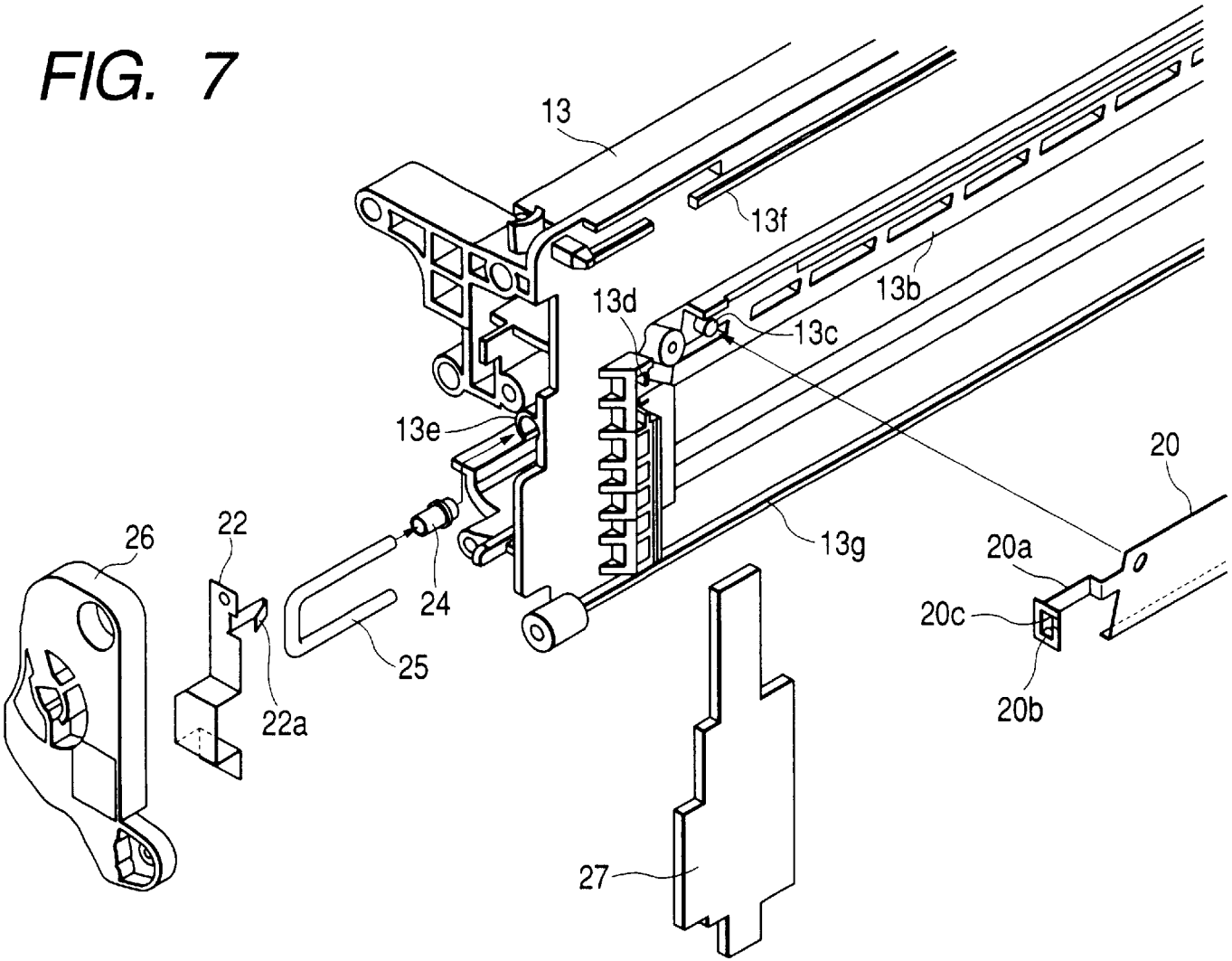
FIG. 7 is an enlarged view of the developing frame of FIG. 6.

As shown in FIG. 6, a holder 26 for rotatably retaining the developing roller 12 via a bearing is attached to the side of the developing frame 13, to which the above-mentioned electric contact 22 is attached. A contact portion 22*a* is provided in the electric contact 22 and, when the holder 26 is attached to the developing frame 13, the electric contact 22 and the detection electrode 20 are electrically connected by the contact portion 22*a* contacting the electrode 25.

A configuration of combining the developing frame 13 and the toner containing portion 14 will now be described.

Protrusions 13*f* and 13*g* that fit in grooves (not shown) for connection provided in the toner containing portion 14 are provided on the surface of the developing frame 13 contacting the toner containing portion 14. Triangle ribs formed for ultrasonic welding are provided on the top surfaces of the protrusions 13*f* and 13*g*. In addition, frame seals 27 and 28 are stuck to both the ends of the developing frame 13 for preventing toner from leaking through a gap between the developing frame 13 and the toner containing portion 14. A sponge-like material is used as the frame seals 27 and 28.

The developing frame 13 after various parts are incorporated and the toner containing portion 14 are pressed in the state in which the grooves of the toner containing portion 14 and the protrusions 13*f* and 13*g* of the developing frame 13 are fit, and ultrasonic vibration is applied to the part between the groove and the protrusion 13*f* and 13*g*. Then, the above-mentioned triangle ribs are melted by frictional heat and welded to the bottom of the groove, and the developing frame 13 and the toner containing portion 14 are integrally connected.

As described above, in this embodiment, electric conduction can be secured by connecting the detection electrode 20 and the electric contact 22 using the electrode 25. In addition, since an electrode or the like is not disposed under the frame seal 27, a preferable sealing characteristic free from toner leakage from the frame seal portion can be attained. In addition, the gap between the electrode 25 and the developing frame 13 is securely sealed by the elastic sealing member 24.

Thus, according to this embodiment. a developing device, a process cartridge and an electrophotographic image forming apparatus that can be easily assembled, prevent the occurrence of toner leakage, and securely connect the inside and the outside of a developing container electrically are provided.

Embodiment 2

A second embodiment of the present invention will now be described.

Figure 9:
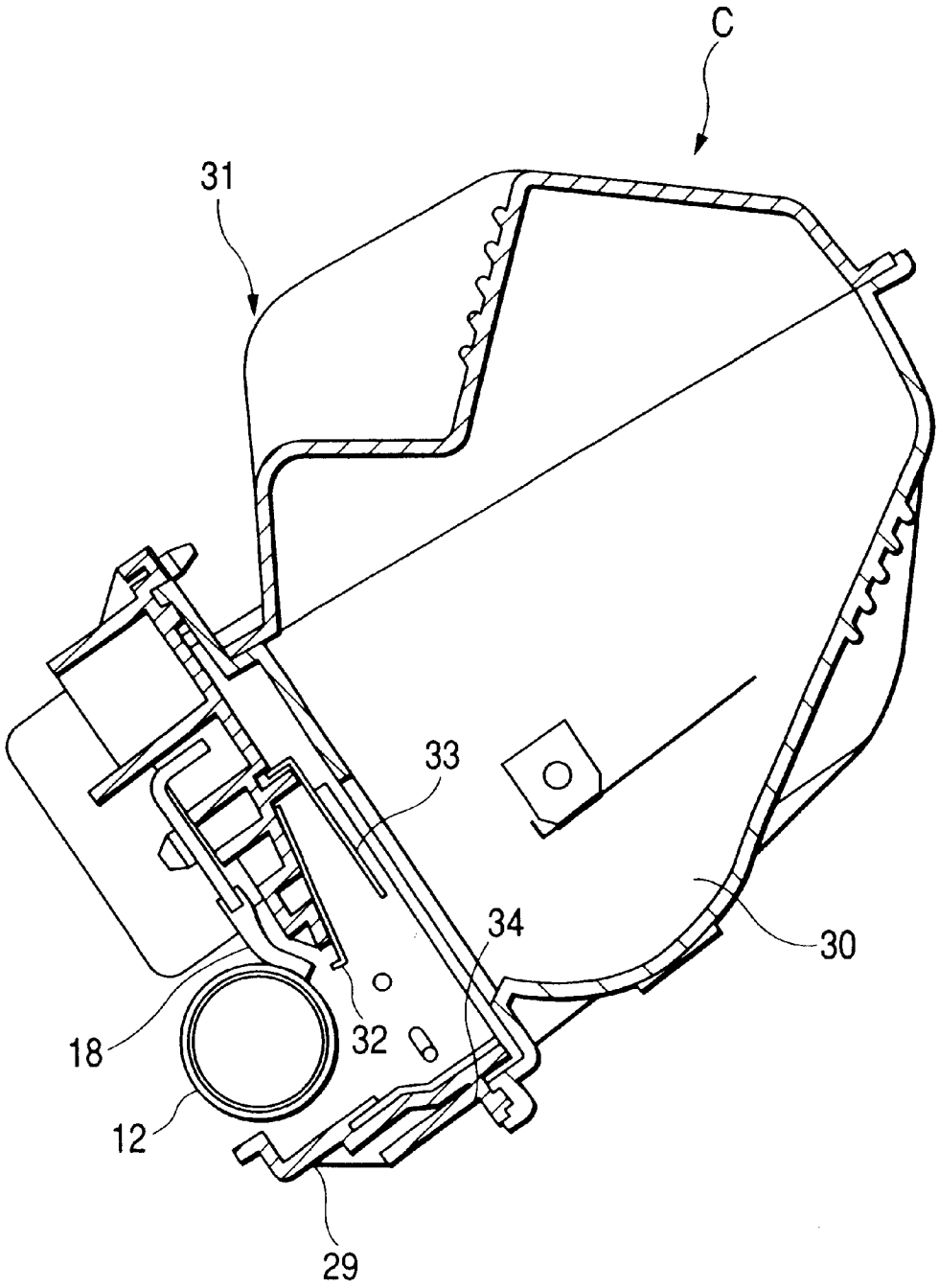
FIG. 9 is a vertical sectional view of another embodiment of a developing device in accordance with the present invention.

As shown in FIG. 9, a developing device C of this embodiment is integrally formed as a cartridge by a developing container 31 that is connected with a developing frame 29, which retains developing means such as a developing roller 12 and a developing blade 18, by welding a toner containing portion 30 to the developing frame 29. That is, the developing device C of this embodiment can be considered as a unit version of a developing device forming portion of the process cartridge B described in the first embodiment, and an integrally formed version of the process cartridge B excluding the cleaning unit.

The developing device C of this embodiment is provided with a third detection electrode 34 in addition to a first and a second detection electrodes 32 and 33 as toner amount detecting means that are capable of detecting a residual amount of toner in accordance with the consumption of the toner in the developing container 31. Since the first and the second detection electrodes 32 and 33 have the same configuration as the first embodiment, their description is omitted.

The third detection electrode 34 is arranged at the bottom of the developing frame 29, and forms a capacitor between the second detection electrode 33 and the third detection electrode 34. That is, two capacitors are formed in the developing container 31; one capacitor is between the first detection electrode 32 and the third detection electrode 33 and the other is between the second detection electrode 33 and the third detection electrode 34. A toner amount is detected by measuring a composited capacitance of these capacitors. Further, the third detection electrode 34 is in the same electric potential as the first detection electrode 32.

Since the overall capacitance can be increased and sensitivity to the change in a toner amount in the developing container 31 can be improved with such a configuration, more accurate detection of a toner amount can be performed.

A configuration for attaching the developing frame 29 and the first and the third detection electrodes 32 and 34 of the developing device C in this embodiment will now be described with reference to FIGS. 10 and 11.

The first detection electrode 32 has the same configuration as that in the first embodiment, and the method of attaching the electrode to the developing frame 29 and the method of wiring the electrode to the outside of the frame are also the same as those in the first embodiment.

Figure 10:
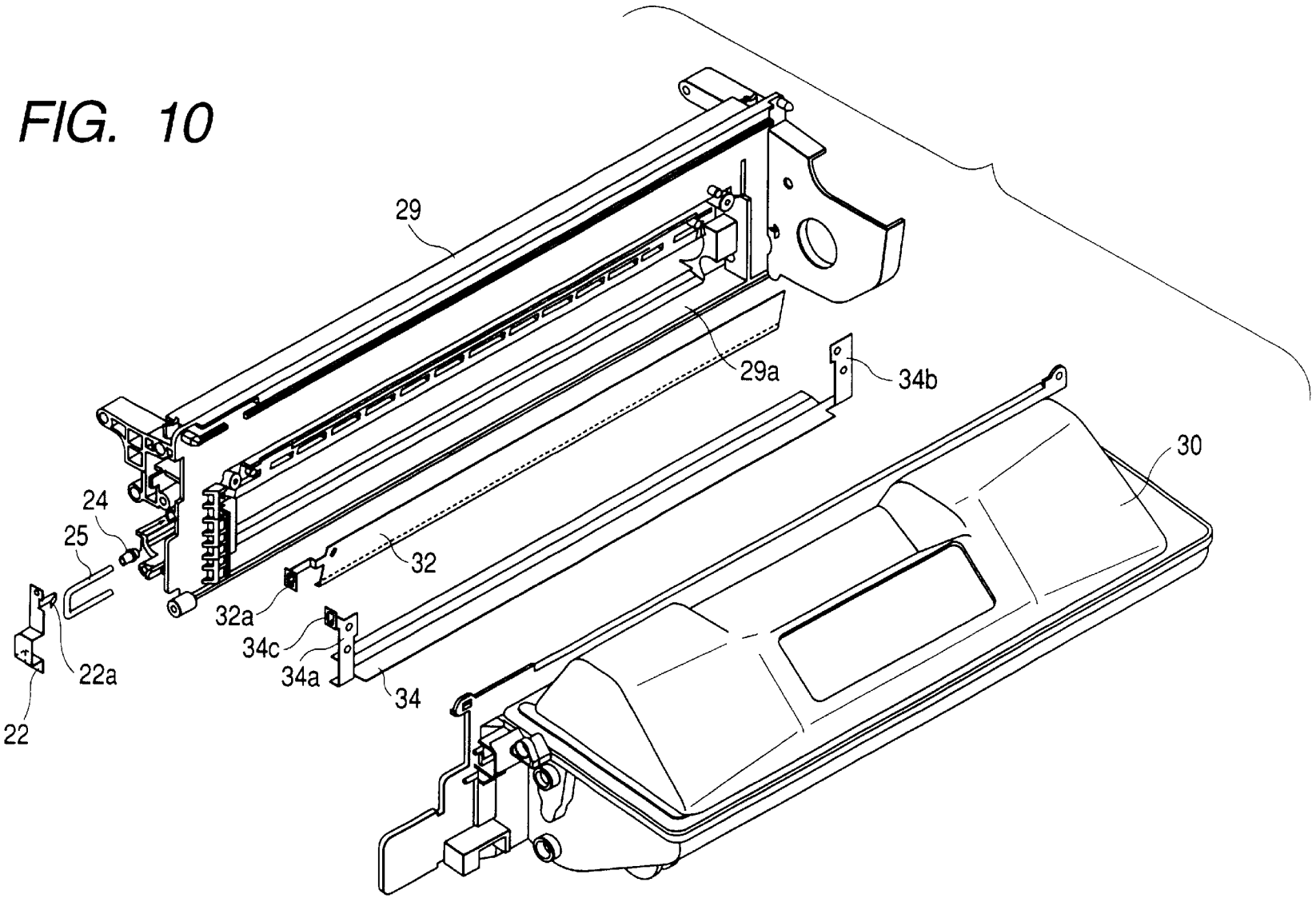
FIG. 10 is an exploded perspective view showing a developing frame in the developing device of FIG. 9.
Figure 11:
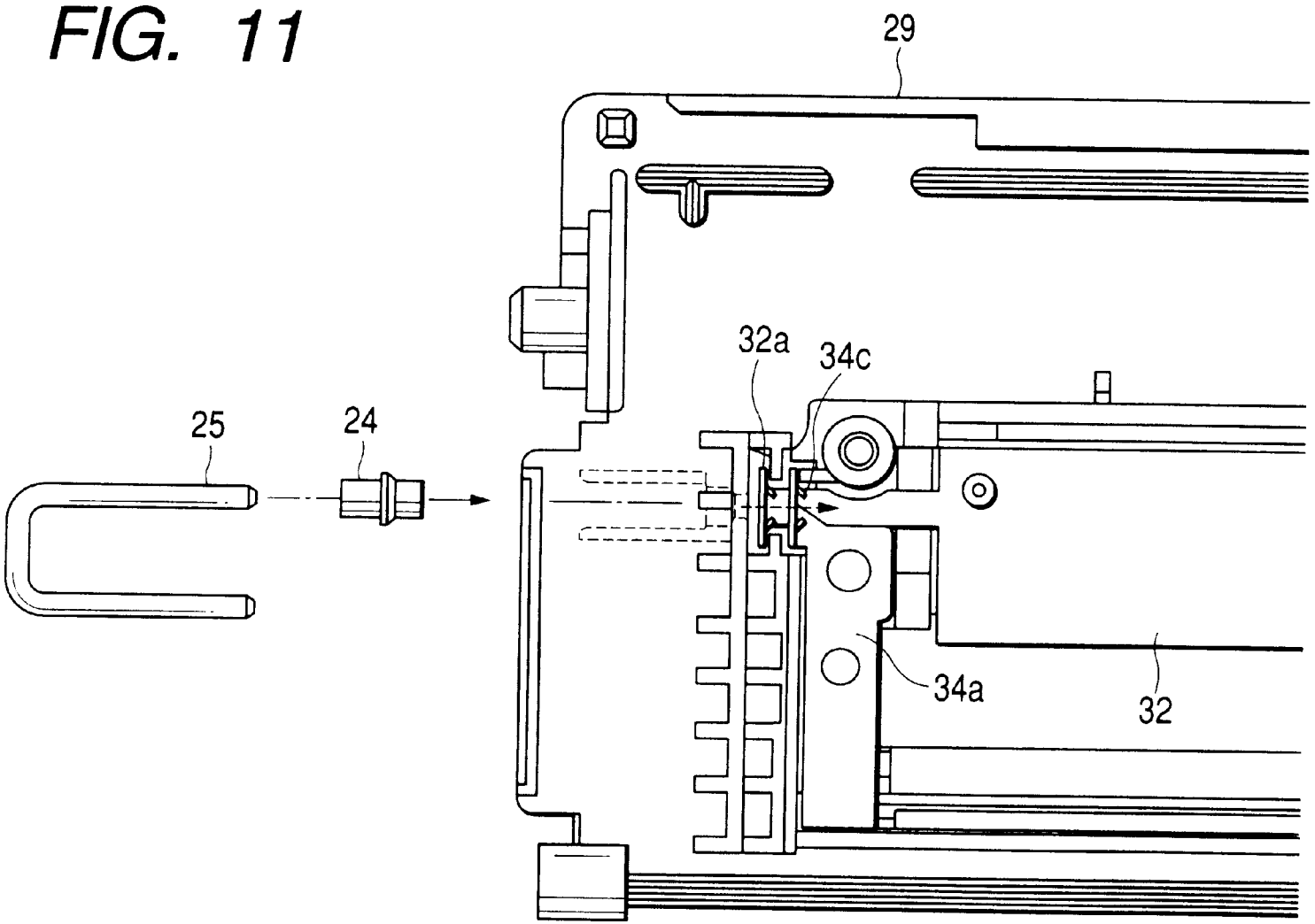
FIG. 11 is an enlarged view showing a main part of the developing frame of FIG. 9.

Arm portions 34*a* and 34*b* extending upward in FIG. 10 are formed at the both ends of the third detection electrode 34 in the longitudinal direction. The third detection electrode 34 is fixed by mounting it on an attaching portion 29*a* of the developing frame 29 and screwing the arm portions 34*a* and 34*b* onto the developing frame 29. An incised clinch 34*c* of the same shape as an incised clinch 32*a* of the first detection electrode 32 is formed at the upper end of the arm portion 34*a* in FIG. 11, and, when a third detection electrode 34 is attached to the developing frame 29, the incised clinch 34*c* of the third detection electrode 34 and the incised clinch 32*a* of the first detection electrode stand side by side or overlap each other.

An electrode 25 is inserted in the developing frame 29 assembled in this way and is press-fit in the incised clinches 32*a* and 34*c* of the first detection electrode 32 and the third detection electrode 34, thus, the first and the third detection electrodes 32 and 34 are securely connected electrically and the wiring from the inside to the outside of the developing container 31 is made. In addition, an elastic sealing member 24 is press-fit into the gap between the electrode 25 and the developing frame 29 as in the first embodiment to prevent toner from leaking.

A method of connecting the developing frame 29 and the toner containing portion 30 and a method of sealing toner at the end of the frame by the frame sealing thereafter are the same as those in the first embodiment.

With such a configuration, reliability of the electric connection can be improved as in the first embodiment and the effect of toner leakage prevention can be attained. Moreover, connection of the two electrodes and wiring to the outside of the developing container can be realized by easy assembling.

According to the toner amount detecting means of each of the above-mentioned embodiments, a residual toner amount can be successively detected with high accuracy.

Figure 12:
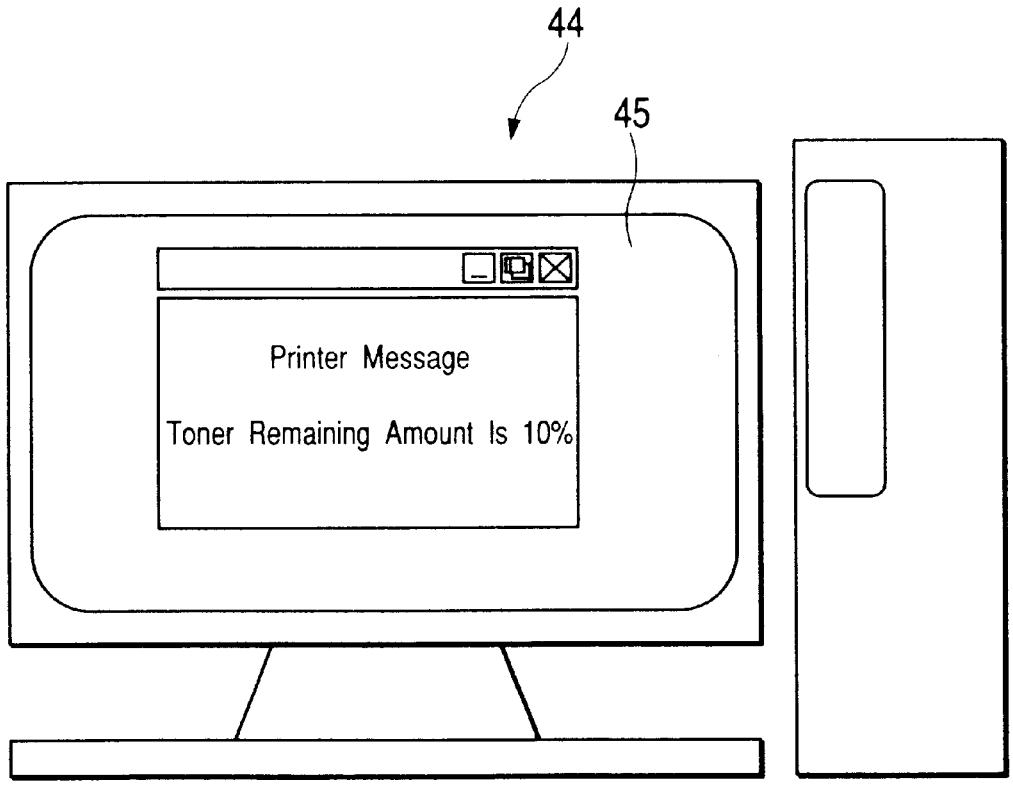
FIG. 12 is an illustration showing an embodiment of a toner amount indication.
Figure 13A:
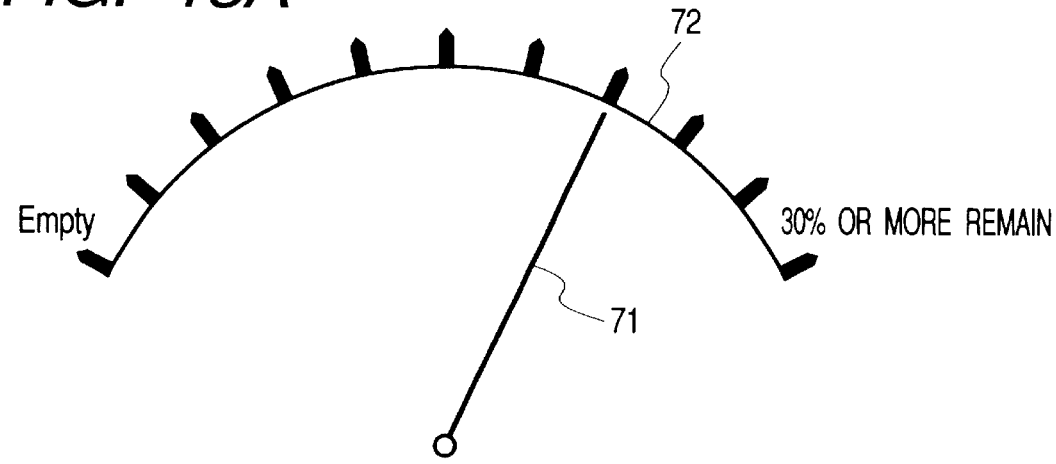
FIGS. 13A and 13B are illustrations showing other embodiments of a toner amount indication.
Figure 13B:
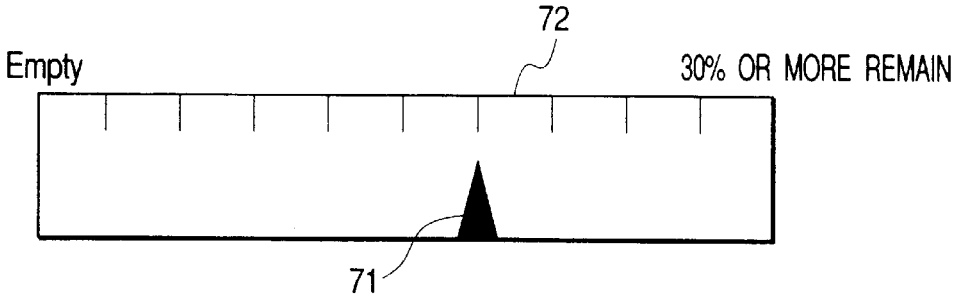

Detection information from the toner amount detecting means is indicated by the toner amount indicating means. Concerning the toner amount indicating means, for example, the detection information is indicated or displayed on a screen 45 of a terminal such as a personal computer 44 of a user as shown in FIG. 12, or as shown in FIGS. 13A and 13B. In FIGS. 13A and 13B, a user is informed of a toner amount as indicated by which part of a gauge 72 a pointer 71 that moves in response to the toner amount points at.

Figure 14:
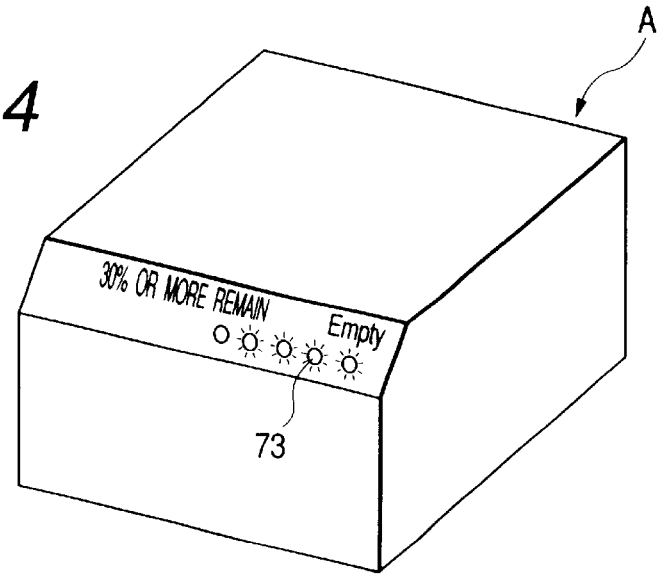
FIG. 14 is an illustration showing another embodiment of a toner amount indication.

In addition, as shown in FIG. 14, an indicating portion such as the one made of LED may be provided directly in the electrophotographic image forming apparatus main body A to turn on and off LED 73 in response to a toner amount.

Further, in the above-mentioned embodiment, if it is assumed that an amount of developer contained in a container is initially 100%, a residual amount of the developer can be successively detected over the entire range of approximately 30% to 0%. However, the present invention is not limited to this, but may be configured to successively detect the residual amount of the developer over the range of 50% to 0% or 40% to 0%. Here, the indication that the residual amount of developer is 0% does not mean that the developer has been completely consumed. For example, the indication that the residual amount of developer is 0% also refers to the state in which, even if the developer remains in the container, the residual amount of the developer has decreased to a level at which a predetermined image quality (development quality) cannot be obtained.

As is evident from the above descriptions, according to the present invention, a developing device, a process cartridge and an electrophotographic image forming apparatus that can be easily assembled, prevent the occurrence of toner leakage, and securely connect the inside and the outside of a developing container electrically are provided.

While the invention has been described with reference to the structure disclosed herein, it is not confined to the details set forth and this application is intended to cover such modifications or changes as may come within the purpose of the improvements or the scope of the following claims.

What is claimed is:

1. A developing device to be mounted on an electrophotographic image forming apparatus main body and used for developing an electrostatic latent image formed on an electrophotographic photosensitive member, comprising:

a developing container;

a first electrode attached to the inside of said developing container, said first electrode having an electric contact portion at one end thereof;

a second electrode, wherein said first and said second electrodes are arranged so that the amount of a developer in said developing device is successively detected by the electrophotographic image forming apparatus main body by detecting a value corresponding to the capacitance between said first and said second electrodes that is generated when voltage is impressed on said first or said second electrode;

a first conductive member for electric conduction from the inside to the outside of said developing container, wherein said first conductive member and said first electrode are electrically connected through said electric contact portion;

a second conductive member having a first contact portion electrically connected to said first conductive member and a second contact portion to be electrically connected to the electrophotographic image forming apparatus main body when said developing device is mounted on the electrophotographic image forming apparatus main body, wherein said second contact portion transmits the value corresponding to the capacitance to the electrophotographic image forming apparatus main body so that the electrophotographic image forming apparatus main body detects the amount of the developer; and an elastic sealing member press-fit in a gap between said first conductive member and said developing container.

2. A developing device to be mounted on an electrophotographic image forming apparatus main body and used for developing an electrostatic latent image formed on an electrophotographic photosensitive member, comprising:

a developing container;

a developer bearing member, which is rotatably attached to said developing container, for conveying developer to the electrophotographic photosensitive member for developing the electrostatic latent image formed on the electrophotographic photosensitive member;

a first electrode attached opposite to said developer bearing member to the inside of said developing container, said first electrode having an electric contact portion at one end thereof;

a second electrode provided opposite to said first electrode, wherein said first and said second electrodes are arranged in positions that allow the developer to enter between said first and said second electrodes so that an amount of the developer is successively detected by the electrophotographic image forming apparatus main body by detecting a value corresponding to the capacitance between said first and said second electrodes which is generated when voltage is impressed on said first or said second electrode;

a first conductive member for electric conduction from the inside to the outside of said developing container, wherein said first conductive member and said first electrode are electrically connected through said electric contact portion;

an elastic sealing member press-fit in a gap between said first conductive member and said developing container; and a second conductive member having a first contact portion electrically connected to said first conductive member and a second contact portion to be electrically connected to the electrophotographic image forming apparatus main body when said developing device is mounted on the electrophotographic image forming apparatus main body, wherein said second contact portion transmits the value corresponding to the capacitance to the electrophotographic image forming apparatus main body so that the electrophotographic image forming apparatus main body detects the amount of the developer.

3. A developing device to be mounted on an electrophotographic image forming apparatus main body and used for developing an electrostatic latent image formed on an electrophotographic photosensitive member, comprising:

a developing container;

a developer bearing member, which is rotatably attached to said developing container, for conveying developer to the electrophotographic photosensitive member for developing the electrostatic latent image formed on the electrophotographic photosensitive member;

a first electrode attached opposite to said developer bearing member to the inside of said developing container;

a second electrode provided opposite to said first electrode, wherein said first and said second electrodes are arranged in positions that allow the developer to enter between said first and said second electrodes so that an amount of the developer is successively detected by the electrophotographic image forming apparatus main body by detecting a value corresponding to the capacitance between said first and said second electrodes which is generated when voltage is impressed on said first or said second electrode;

a third electrode opposite to said second electrode and electrically connected to said first electrode, wherein said third electrode successively detects an amount of developer by detecting a value corresponding to the capacitance between said second and said third electrodes that is generated when voltage is impressed on said second or said third electrode;

a conductive member for electric conduction from the inside to the outside of said developing container, wherein said conductive member and said first and said third electrodes are electrically connected; and an elastic sealing member press-fit in a gap between said conductive member and said developing container.

4. A process cartridge detachably mountable on an electrophotographic image forming apparatus main body, said process cartridge comprising:

(a) an electrophotographic photosensitive member; and (b) a developing device, said developing device comprising:

a developing container;

a first electrode attached to the inside of said developing container, said first electrode having an electric contact portion at one end thereof;

a second electrode, wherein said first and said second electrodes are arranged so that the amount of a developer in said developing device is successively detected by the electrophotographic image forming apparatus main body by detecting a value corresponding to the capacitance between said first and said second electrodes which is generated when voltage is impressed on said first or said second electrode;

a first conductive member for electric conduction from the inside to the outside of said developing container, wherein said first conductive member and said first electrode are electrically connected through said electric contact portion;

a second conductive member having a first contact portion electrically connected to said first conductive member and a second contact portion to be electrically connected to the electrophotographic image forming apparatus main body when said process cartridge is mounted on the electrophotographic image forming apparatus main body, wherein said second contact portion transmits the value corresponding to the capacitance to the electrophotographic image forming apparatus main body so that the electrophotographic image forming apparatus main body detects the amount of the developer; and an elastic sealing member press-fit in a gap between said first conductive member and said developing container.

5. A process cartridge detachably mountable on an electrophotographic image forming apparatus main body, said process cartridge comprising:

(a) an electrophotographic photosensitive member; and (b) a developing device, said developing device comprising:

a developing container;

a developer bearing member, which is rotatably attached to said developing container, for conveying developer to said electrophotographic photosensitive member for developing an electrostatic latent image formed on said electrophotographic photosensitive member;

a first electrode attached opposite to said developer bearing member to the inside of said developing container, said first electrode having an electric contact portion at one end thereof;

a second electrode provided opposite to said first electrode, wherein said first and said second electrodes are arranged in positions that allow the developer to enter between said first and said second electrodes so that an amount of the developer is successively detected by the electrophotographic image forming apparatus main body by detecting a value corresponding to the capacitance between said first and said second electrodes which is generated when voltage is impressed on said first or said second electrode;

a first conductive member for electric conduction from the inside to the outside of said developing container, wherein said first conductive member and said first electrode are electrically connected through said electric contact portion;

an elastic sealing member press-fit in a gap between said first conductive member and said developing container; and a second conductive member having a first contact portion electrically connected to said first conductive member and a second contact portion to be electrically connected to the electrophotographic image forming apparatus main body when said process cartridge is mounted on the electrophotographic image forming apparatus main body, wherein said second contact portion transmits the value corresponding to the capacitance to the electrophotographic image forming apparatus main body so that the electrophotographic image forming apparatus main body detects the amount of the developer.

6. A process cartridge detachably mountable on an electrophotographic image forming apparatus main body, said process cartridge comprising:

(a) an electrophotographic photosensitive member; and (b) a developing device, said developing device comprising:

a developing container;

a developer bearing member, which is rotatably attached to said developing container, for conveying developer to said electrophotographic photosensitive member for developing an electrostatic latent image formed on said electrophotographic photosensitive member;

a first electrode attached opposite to said developer bearing member to the inside of said developing container;

a second electrode provided opposite to said first electrode, wherein said first and said second electrodes are arranged in positions that allow the developer to enter between said first and said second electrodes so that an amount of the developer is successively detected by the electrophotographic image forming apparatus main body by detecting a value corresponding to the capacitance between said first and said second electrodes which is generated when voltage is impressed on said first or said second electrode;

a third electrode opposite to said second electrode and electrically connected to said first electrode, wherein said third electrode successively detects an amount of developer by detecting a value corresponding to the capacitance between said second and said third electrodes that is generated when voltage is impressed on said second or said third electrode;

a conductive member for electric conduction from the inside to the outside of said developing container, wherein said conductive member and said first and said third electrodes are electrically connected; and an elastic sealing member press-fit in a gap between said conductive member and said developing container.

7. An electrophotographic image forming apparatus for forming an image on a recording medium, said apparatus comprising:

(a) an electrophotographic photosensitive member;

(b) electrostatic latent image forming means for forming an electrostatic latent image on said electrophotographic photosensitive member; and (c) a developing device, said developing device comprising:

a developing container;

a first electrode attached to the inside of said developing container, said first electrode having an electric contact portion at one end thereof;

a second electrode, wherein said first and said second electrodes are arranged so that the amount of a developer in said developing device is successively detected by an electrophotographic image forming apparatus main body by detecting a value corresponding to the capacitance between said first and said second electrodes which is generated when voltage is impressed on said first or said second electrode;

a first conductive member for electric conduction from the inside to the outside of said developing container, wherein said first conductive member and said first electrode are electrically connected through said electric contact portion;

a second conductive member having a first contact portion electrically connected to said first conductive member and a second contact portion to be electrically connected to the electrophotographic image forming apparatus main body, wherein said second contact portion transmits the value corresponding to the capacitance to the electrophotographic image forming apparatus main body so that the electrophotographic image forming apparatus main body detects the amount of the developer; and an elastic sealing member press-fit in a gap between said first conductive member and said developing container.

8. An electrophotographic image forming apparatus, on which a process cartridge is detachably mountable, for forming an image on a recording medium, said apparatus comprising:

(a) mounting means for detachably mounting the process cartridge, the process cartridge comprising:

an electrophotographic photosensitive member; and a developing device, the developing device comprising:

a developing container;

a first electrode attached to the inside of the developing container, the first electrode having an electric contact portion of one end thereof;

a second electrode, wherein the first and second electrodes are arranged so that the amount of a developer in the developing device is successively detected by an electrophotographic image forming apparatus main body by detecting a value corresponding to the capacitance between the first and second electrodes which is generated when voltage is impressed on the first or second electrode;

a first conductive member for electric conduction from the inside to the outside of the developing container, wherein the first conductive member and the first electrode are electrically connected through the electric contact portion;

a second conductive member having a first contact portion electrically connected to the first conductive member and a second contact portion to be electrically connected to the electrophotographic image forming apparatus main body when the process cartridge is mounted on said mounting means, wherein the second contact portion transmits the value corresponding to the capacitance to the electrophotographic image forming apparatus main body so that the electrophotographic image forming apparatus main body detects the amount of the developer; and an elastic sealing member press-fit in a gap between the first conductive member and the developing container; and (b) electrostatic latent image forming means for forming an electrostatic latent image on the electrophotographic photosensitive member.

9. An electrophotographic image forming apparatus for forming an image on a recording medium, said apparatus comprising:

(a) an electrophotographic photosensitive member;

(b) electrostatic latent image forming means for forming an electrostatic latent image on said electrophotographic photosensitive member; and (c) a developing device, said developing device comprising:

a developing container;

a developer bearing member, which is rotatably attached to said developing container, for conveying developer to said electrophotographic photosensitive member for developing the electrostatic latent image formed on said electrophotographic photosensitive member;

a first electrode attached opposite to said developer bearing member to the inside of said developing container, said first electrode having an electric contact portion at one end thereof;

a second electrode provided opposite to said first electrode, wherein said first and said second electrodes are arranged in positions that allow the developer to enter between said first and said second electrodes so that an amount of the developer is successively detected by an electrophotographic image forming apparatus main body by detecting a value corresponding to the capacitance between said first and said second electrodes which is generated when voltage is impressed on said first or said second electrode;

a first conductive member for electric conduction from the inside to the outside of said developing container, wherein said first conductive member and said first electrode are electrically connected through said electric contact portion;

an elastic sealing member press-fit in a gap between said first conductive member and said developing container; and a second conductive member having a first contact portion electrically connected to said first conductive member and a second contact portion to be electrically connected to the electrophotographic image forming apparatus main body, wherein said second contact portion transmits the value corresponding to the capacitance to said electrophotographic image forming apparatus main body so that the electrophotographic image forming apparatus main body detects the amount of the developer.

10. An electrophotographic image forming apparatus, on which a process cartridge is detachably mountable, for forming an image on a recording medium, said apparatus comprising:

(a) mounting means for detachably mounting the process cartridge, the process cartridge comprising:

an electrophotographic photosensitive member; and a developing device, the developing device comprising:

a developing container;

a developer bearing member, which is rotatably attached to the developing container, for conveying developer to the electrophotographic photosensitive member for developing an electrostatic latent image formed on the electrophotographic photosensitive member;

a first electrode attached opposite to the developer bearing member to the inside of the developing container, the first electrode having an electric contact portion at one end thereof;

a second electrode provided opposite to the first electrode, wherein the first and second electrodes are arranged in positions that allow the developer to enter between the first and second electrodes so that an amount of the developer is successively detected by an electrophotographic image forming apparatus main body by detecting a value corresponding to the capacitance between the first and second electrodes which is generated when voltage is impressed on the first or second electrode;

a first conductive member for electric conduction from the inside to the outside of the developing container, wherein the first conductive member and the first electrode are electrically connected through the electric contact portion;

an elastic sealing member press-fit in a gap between the first conductive member and the developing container; and a second conductive member having a first contact portion electrically connected to the first conductive member and a second contact portion to be electrically connected to the electrophotographic image forming apparatus main body when the process cartridge is mounted on said mounting means, wherein the second contact portion transmits the value corresponding to the capacitance to the electrophotographic image forming apparatus main body so that the electrophotographic image forming apparatus main body detects the amount of the developer; and (b) electrostatic latent image forming means for forming the electrostatic latent image on the electrophotographic photosensitive member.

11. An electrophotographic image forming apparatus for forming an image on a recording medium, said apparatus comprising:

(a) an electrophotographic photosensitive member;

(b) electrostatic latent image forming means for forming an electrostatic latent image on said electrophotographic photosensitive member; and (c) a developing device, said developing device comprising:

a developing container;

a developer bearing member, which is rotatably attached to said developing container, for conveying developer to said electrophotographic photosensitive member for developing the electrostatic latent image formed on said electrophotographic photosensitive member;

a first electrode attached opposite to said developer bearing member to the inside of said developing container;

a second electrode provided opposite to said first electrode, wherein said first and said second electrodes are arranged in positions that allow the developer to enter between said first and said second electrodes so that an amount of the developer is successively detected by an electrophotographic image forming apparatus main body by detecting a value corresponding to the capacitance between said first and said second electrodes which is generated when voltage is impressed on said first or said second electrode;

a third electrode opposite to said second electrode and electrically connected to said first electrode, wherein said third electrode successively detects an amount of developer by detecting a value corresponding to the capacitance between said second and said third electrodes that is generated when voltage is impressed on said second or said third electrode;

a conductive member for electric conduction from the inside to the outside of said developing container, wherein said conductive member and said first and said third electrodes are electrically connected; and an elastic sealing member press-fit in a gap between said conductive member and said developing container.

12. An electrophotographic image forming apparatus, on which a process cartridge is detachably mountable, for forming an image on a recording medium, said apparatus comprising:

(a) mounting means for detachably mounting the process cartridge, the process cartridge comprising:

an electrophotographic photosensitive member; and a developing device, the developing device comprising:

a developing container;

a developer bearing member, which is rotatably attached to the developing container, for conveying developer to the electrophotographic photosensitive member for developing an electrostatic latent image formed on the electrophotographic photosensitive member;

a first electrode attached opposite to the developer bearing member to the inside of the developing container;

a second electrode provided opposite to the first electrode, wherein the first and the second electrodes are arranged in positions that allow the developer to enter between the first and second electrodes so that an amount of the developer is successively detected by an electrophotographic image forming apparatus main body by detecting a value corresponding to the capacitance between the first and second electrodes which is generated when voltage is impressed on the first or second electrode;

a third electrode opposite to the second electrode and electrically connected to the first electrode, wherein the third electrode successively detects an amount of developer by detecting a value corresponding to the capacitance between the second and the third electrodes that is generated when voltage is impressed on the second or the third electrode;

a conductive member for securing electric conduction from the inside to the outside of the developing container, wherein the conductive member and the first and third electrodes are electrically connected; and an elastic sealing member press-fit in a gap between the conductive member and the developing container; and (b) electrostatic latent image forming means for forming the electrostatic latent image on the electrophotographic photosensitive member.

13. A developing device according to claim 1 or 2, wherein said first conductive member is press-fit in a fitting portion of said first electrode.

14. A process cartridge according to claim 4 or 5, wherein said first conductive member is press-fit in a fitting portion of said first electrode.

15. An electrophotographic image forming apparatus according to claim 7, wherein said first conductive member is press-fit in a fitting portion of said first electrode.

16. A developing device according to claim 1, wherein said second electrode is provided opposite to said first electrode.

17. A process cartridge according to claim 4, wherein said second electrode is provided opposite to said first electrode.

18. An electrophotographic image forming apparatus according to claim 8, wherein the first conductive member is press-fit in a fitting portion of the first electrode.

19. A developing device according to claim 1 or 2, wherein said first conductive member is press-fit in said electric contact portion so as to be electrically connected to said first electrode.

20. A process cartridge according to claim 4 or 5, wherein said first conductive member is press-fit in said electric contact portion so as to be electrically connected to said first electrode.

* * * * *

UNITED STATES PATENT AND TRADEMARK OFFICE

CERTIFICATE OF CORRECTION

PATENT NO. : 6,704,525 B2
DATED : March 9, 2004
INVENTOR(S) : Toru Oguma et al.

It is certified that error appears in the above-identified patent and that said Letters Patent is hereby corrected as shown below:

Title page,
Item [56], References Cited, FOREIGN PATENT DOCUMENTS,
"JP 2000076639 *3/2000
JP 2000219353 *8/2000"
should read
-- JP 2000-575639 *3/2000
JP 2000-219353 *8/2000 --

Column 1,
Line 12, "visualize" should read -- visualizes --.

Column 3,
Line 60, "pairs" should read -- pair --.

Column 4,
Line 6, "pairs" should read -- pair --.
Line 44, "electrodes" should read -- electrode --.
Line 65, "contacts" should read -- contact --.

Column 6,
Line 20, "embodiment." should read -- embodiment, --.
Line 42, "electrodes" should read -- electrode --.

Column 7,
Line 17, "electrode" should read -- electrode 32 --.

Column 12,
Line 42, "of" should read -- at --.

UNITED STATES PATENT AND TRADEMARK OFFICE

CERTIFICATE OF CORRECTION

PATENT NO. : 6,704,525 B2
DATED : March 9, 2004
INVENTOR(S) : Toru Oguma et al.

It is certified that error appears in the above-identified patent and that said Letters Patent is hereby corrected as shown below:

Column 15,
Line 12, "for" should read -- for securing --.

Signed and Sealed this

Twenty-seventh Day of July, 2004

JON W. DUDAS
*Acting Director of the United States Patent and Trademark Office*